United States Patent [19]

Larson

[11] 3,985,324

[45] Oct. 12, 1976

[54] TOOL HOLDER FOR PEGBOARD

[75] Inventor: Charles O. Larson, Sterling, Ill.

[73] Assignee: Charles O. Larson Co., Sterling, Ill.

[22] Filed: Oct. 16, 1975

[21] Appl. No.: 622,968

[52] U.S. Cl. ..... 248/223; 211/60 T

[51] Int. Cl.[2] ..... A47F 7/00; A47G 23/02; F16M 13/00

[58] Field of Search ..... 248/223, 224, 225, 220.5, 248/DIG. 3; 211/60 T, 60 R, 66, 89

[56] References Cited

UNITED STATES PATENTS

| | | | |
|---|---|---|---|
| 2,094,655 | 10/1937 | Holden | 211/89 |
| 2,432,802 | 12/1947 | Reynolds | 211/89 X |
| 2,468,190 | 4/1949 | Friedheim | 211/60 T UX |
| 2,991,968 | 7/1961 | Lydard | 248/223 |
| 3,187,902 | 6/1965 | Nelson | 211/60 T |
| 3,285,426 | 11/1966 | Wilcke | 211/60 T |
| 3,343,684 | 9/1967 | Galier | 211/89 |
| 3,677,415 | 7/1972 | Radek | 248/DIG. 3 |
| 3,799,466 | 3/1974 | Adams | 248/DIG. 3 |
| 3,853,293 | 12/1974 | Larson | 248/DIG. 3 X |

*Primary Examiner*—J. Franklin Foss
*Attorney, Agent, or Firm*—Olson, Trexler, Wolters, Bushnell & Fosse, Ltd.

[57] ABSTRACT

A tool holder is disclosed for mounting garden tools and the like on a garage wall pegboard or similar site. The holder includes a standard having a pair of outwardly and upwardly flaring tool-supporting arms. To mount this standard on the pegboard, a bracket has a platform shaped for superimposition over a mediate standard web. Tabs extending from bracket platform bases engage holes formed in the pegboard.

7 Claims, 3 Drawing Figures

12
11
2
68
46
65
64
66
16
10
15
69
44
28
67
31
30
18
25
40
17
22
27
30
21
45
2

19
10
68
44
65
52
22
66
50
30
70
33
11
47
25
46
18
17
41
49
42
45
51
61
53

15
67
69
64
68
10
21
16
65
66
22
27
25
33
28
18
17
Y
X
60
61

TOOL HOLDER FOR PEGBOARD

BACKGROUND OF THE INVENTION

This invention relates generally to mounts or holders for tools, and more particularly to a tool holder for garden tools and the like which can be mounted to a peg board in a basement, garage or tool shed.

Garden tools such as rakes, shovels, hoes and the like are often stored in locations where the tools may become a hazard to persons in their vicinity. Unwary or careless people may step on a sharp or pointed tool end, or brush against a precariously balanced implement. These encounters invariably cause aggravation, and can cause serious injury.

To eliminate such hazards, many people hang such tools on hooks, pegs, nails, or other wall mounts. However, the amount of wall surface available for hanging such tools is often limited, and it is common practice to store a number of tools in stacked relationship upon the same hook or peg. Stacked and hung tools are also hazardous since the endmost tool may fall from the stack, and since the supportive mount may be unable to carry the aggregate weight of these tools.

A number of hooks and other mounts have been offered to provide a sturdy and safe structure for compactly storing a number of such tools. However, many of these tool holders are expensive and are, in reality, not much safter or more efficient than the simple nails or hooks they are offered to replace. Other holders consist of a number of parts, and their proper installation may prove incomprehensible or impossible — especially when attempted by one unfamiliar with moderately complex hardware.

Accordingly, it is the general object of the present invention to provide a holder for yard tools and the like which is simple and inexpensive to make and install, yet which is rugged in use.

A more specific object of the invention is to provide a holder for yard tools and the like which is constructed of but a few parts. A related object is to provide parts designed to make apparent their proper installation even to those inexperienced with hardware installation practice.

Another object is to provide a yard tool holder which can be made and offered at an attractive commercial price. A related object is to provide a holder which can be fabricated without extensive labor or the generation of waste material.

Other objects and advantages of the invention will become apparent from reading the following detailed description and upon reference to the drawings. Throughout the drawings, like reference numerals refer to like parts.

While the invention will be described in connection with a preferred embodiment, it will be understood that it is not intended to limit the invention to this embodiment. On the contrary, it is intended to cover all alternatives, modifications and equivalents as may be included within the spirit and scope of the invention.

Figure 1:
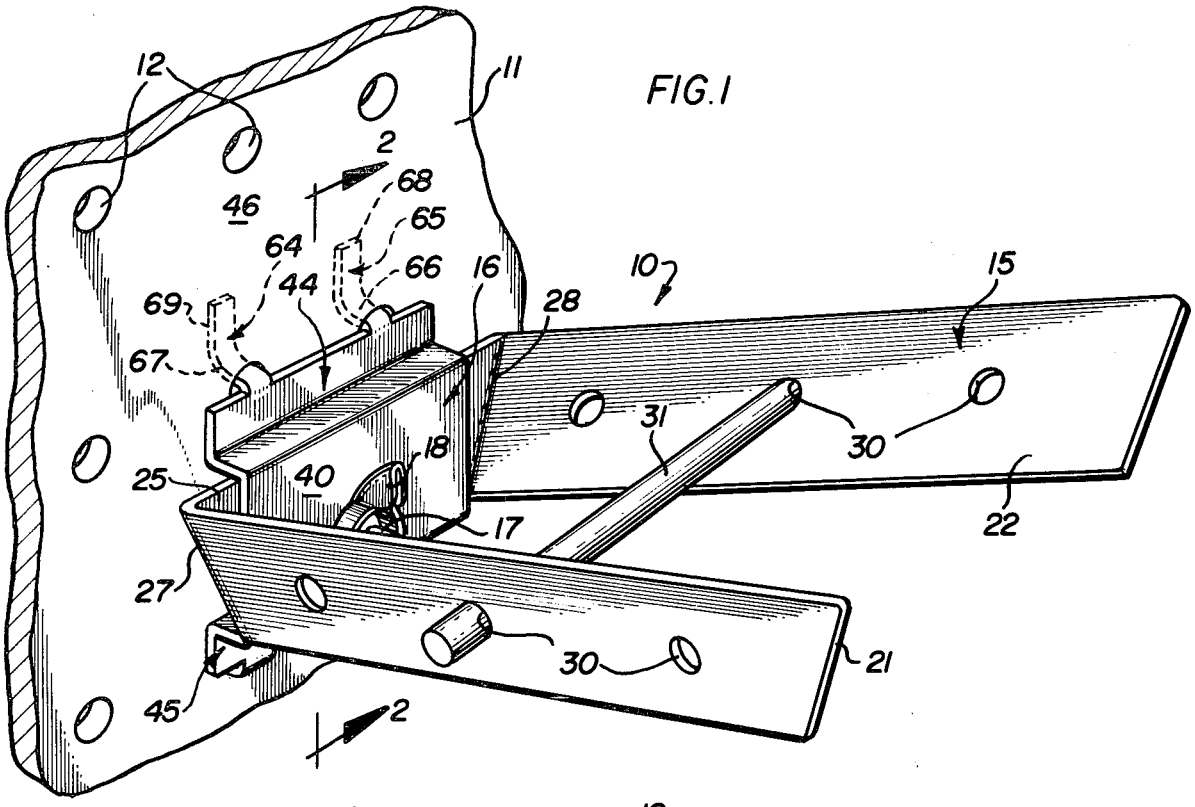
FIG. 1 is a perspective view showing the novel tool in general aspect as it appears when mounted upon a typical pegboard or like site.

Turning first to FIG. 1, there is shown a novel tool holder 10 embodying the present invention which is adapted for mounting upon a planar bi-sided wall 11. In providing the illustrated embodiment of the present invention, it is contemplated that this wall 11 will be of the common pegboard variety, and as such the wall 11 defines a matrix of attachment holes 12 located at regular intervals throughout the wall extent. In general, the holder 10 can be considered to include a U-shaped standard 15 and a bracket 16, which are held together by a headed and threaded bolt 17 and wing nut 18.

To urge the retained tools 19 toward the wall 11 in a compact stack out of the way of passers-by, and to cradle them so as to prevent their being inadvertently dislodged from the holder, the standard 15 comprises a pair of outwardly flaring and upwardly inclined arms 21 and 22. These arms 21 and 22 are attached to one another and to the bracket 16 by a mediate trapezoidally-shaped central web 25 which is of predetermined width and thickness, and of minimum length X, as shown especially in FIG. 3. Opposite lateral web margins 27 and 28 are defined by diagonally oriented, downwardly converging bend lines. To minimize finished tool holder cost, this standard can be formed of metallic strip stock having a uniform thickness and width throughout its entire length.

It will be noted that these tool holder arms 21 and 22 extend outwardly for a distance sufficient to permit storage of a plurality of tools in stacked relationship. To prevent the stored tools from becoming entangled, aligned holes 30 are formed in the arms. If desired, separator pins or rods 31 can be slipped through the mating holes 30. When the tools are placed upon the tool holder arms 21 and 22, gravity forces them to slide downwardly toward the wall 11 and into a resting position against the rods 31. Thus, the tools 19 are stored in a compact, stacked relationship closely adjacent the wall 11. It will be understood that if but a single tool is to be stored, or if the user simply so desires, these rods 30 can be removed.

Figure 2:
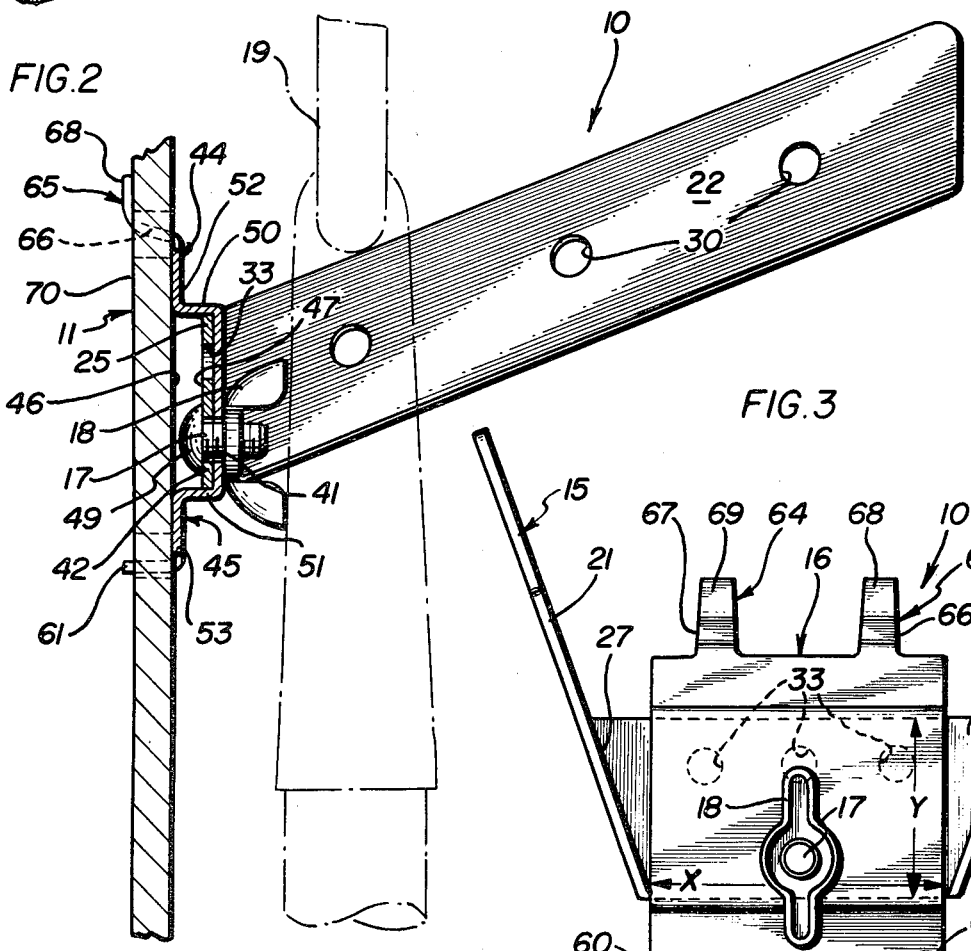
FIG. 2 is a sectional view taken substantially in the plane of line 2—2 in FIG. 1.
Figure 3:
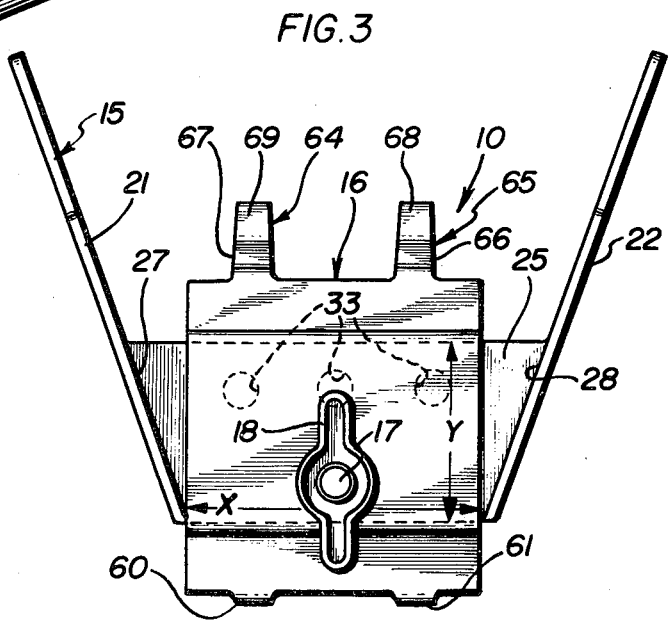
FIG. 3 is a front elevational view of the tool holder shown in FIGS. 1 and 2.

As illustrated especially in FIGS. 2 and 3, the central web 25 may be punched or otherwise worked to define a number of holes 33 of a size which will accept common varieties of wood or metal screws. These holes and the mating fasteners can be used to attached the standard 15 directly to a wall. If desired, two of these three holes 33 may be spaced apart by a distance which is an integral multiple of common pegboard hole dimensions, to permit this standard attachment to be made directly to a pegboard. It will be understood that the standard 15 could be directly attached, alternatively, to a nonpegboard surface in similar manner.

In accordance with the invention, the bracket 16 provides structure for quickly, easily and securely attaching the standard 15 to a pegboard 11. To this end, it includes a platform 40 which is of a width sufficient to cover the predetermined standard web width Y, and of a length X substantially equal to the minimum standard web length X, so as to superimpositionally fit over the standard web 25 without relative movement. It is a feature of the invention that correct alignment of the bracket 16 with the standard 15 is clearly suggested in this way, and holder assembly can be accomplished quickly and accurately even by those who are unfamiliar with modern hardware design.

As illustrated, a hole 41 is formed in the bracket platform 40; a second hole 42 is formed in the lower portion of the standard web 25 in registry with the platform hole 41. Through these two holes 41 and 42, the threaded bolt 17 is inserted. The wing nut 18 can be used to secure this bolt 17 in the two holes 41 and 42 and yet provide for quick disassembly. By locating the two registering holes 41 and 42 at a location other than the center of the superimposed standard web 25 and bracket platform 40, improper bracket-standard assembly will be made evident to even those who are inexperienced in assembling simple hardware devices for home use.

Top and bottom bases 44 and 45 extend perpendicularly from the platform 40 to provide head clearance space between a front surface 46 of the wall 11 and a back surface 47 of the standard web 25 which is sufficient in extent to accommodate the enlarged head 49 of the screw 17. More particularly, this stand-off distance is provided by forming base legs 50 and 51 of the desired perpendicular length. Feet 52 and 53 depending from the respective legs 50 and 51 which abuttively engage the outer wall surface 46 and which provide a firm compressive foundation for the tool holder when it is attached to the wall as illustrated.

To positively attach the bracket 16 to the peg board 11, a plurality of tabs extend from these bases 44 and 45. Here, two lower tabs 60 and 61 are of the bayonet form and extend from the bottom base foot 53 perpendicularly to the plane of the platform 40 for insertion into appropriate wall holes 12. When so inserted, these bayonet tabs 60 and 61 prohibit bracket and standard motion in a plane parallel to the plane of the wall 11.

Hook tabs 64 and 65 extend from the upper base foot 52. These hooks have shanks 66 and 67 extending perpendicularly to the bracket platform 40, and they each terminate in an angled hook tip 68 and 69, respectively, which engages a rear or back wall surface 70 of the pegboard 11. Standard and bracket pivotal motion away from the wall is prevented by these hooks; the bracket 16, standard 15, and any held tools 19 are thereby retained on the wall 11.

The invention is claimed as follows:

1. A tool holder for mounting upon a planar bi-sided wall defining a matrix of attachment holes located at regular intervals, comprising, in combination, a U-shaped standard including a trapezoidally-shaped central web of predetermined width and minimum length and having opposite side margins defined by diagonally oriented, downwardly converging bend lines, and a pair of outwardly flaring and upwardly inclined arms extending from the central web at the bend lines, and defining a plurality of aligned arm holes, and a plurality of rods adapted for insertion in the aligned arm holes, the rods thus providing supports against which the tools may rest in a compact and secure yet noninterengaging stacked array, the holder further comprising a bracket including a platform having a width sufficient to cover the predetermined width of the standard web and a length substantially equal to the minimum length of the standard web so as to superimpositionally fit over the standard web without relative movement, top and bottom bases extending perpendicularly from the platform for a sufficient distance to provide head clearance spaced between a front wall surface and a back web surface for retention of a headed standard-bracket fastener, a threaded fastener having an enlarged head retained in the clearance between said wall surface and said standard web surface and a threaded shank of reduced diameter extending through registered holes in the standard web and bracket platform, a threaded fastener retainer for attachment to the threaded fastener at a position adjacent the bracket platform and having a thickness exceeding said head clearance space so as to indicate improper assembly of the tool holder parts to the holder user, the standard and web each defining additional holes which are misaligned to prohibit improper bracket-standard assembly, and a plurality of tabs extending from the bases for fastening the bracket and attached standard to the wall, the tabs including at least one bayonet tab extending from the bottom base perpendicularly to the bracket platform for insertion into a wall hole so as to prohibit bracket and standard motion in a plane parallel to the wall plane, and at least one hook tab having a hook shank extending perpendicularly to the bracket platform and a hook tip extending at an angle away from the hook shank so as to engage a back wall surface and to thereby retain the bracket, standard, and any held tools on the wall.

2. A tool holder according to claim 1 wherein said bracket platform bases each include a leg portion extending perpendicularly away from the platform, and a foot extending perpendicularly away from the leg for abutment against the outer wall surface.

3. A tool holder for mounting upon a bi-sided planar wall defining a matrix of attachment holes located at regular intervals, comprising a U-shaped standard including a trapezoidally-shaped central web of predetermined width and thickness and minimum length, and having opposite margins defined by diagonally oriented, downwardly converging bend lines, and a pair of outwardly flaring and upwardly inclined arms extending from the central web at the bend lines, and defining a plurality of aligned arm holes, a plurality of rods adapted for insertion in the aligned arm holes, the rods thus providing supports against which the tools may rest in a compact and secure yet noninterengaging stacked array, and a bracket including a platform having a width sufficient to cover the predetermined width of the standard web and a length substantially equal to the minimum length of the standard web so as to superimpositionally fit over the standard web without relative movement, top and bottom bases extending over the thickness of the web and a plurality of tabs extending from the bases for fastening the bracket and attached standard to the wall.

4. A tool holder according to claim 3 wherein the U-shaped standard is formed of metallic strip stock having uniform thickness and width throughout its entire length.

5. A tool holder according to claim 3, including at least one bayonet tab extending from the bottom base perpendicularly to the bracket platform for insertion into a wall hole so as to prohibit bracket and standard motion in a plane parallel to the wall plane, and at least one hook tab having a hook shank extending perpendicularly to the bracket platform and a hook tip extending away from the hook shank to engage a back wall surface and to thereby retain the bracket, standard and any held tools on the wall.

6. A tool holder according to claim 5 wherein said top tabs and said bottom tabs are spaced apart by distances equal to integral multiples of the distance between the wall hole spaces.

7. A tool holder for mounting upon a planar bi-sided wall defining a matrix of attachment holes located at regular intervals, comprising, in combination, a U-shaped standard including a trapezoidally-shaped central web of predetermined width and minimum length and having opposite side margins defined by diagonally oriented, downwardly converging bend lines, and a pair of outwardly flaring and upwardly inclined arms extending from the central web at the bend lines, and defining a plurality of aligned arm holes, a plurality of rods adapted for insertion in the aligned armholes, the rods thus providing supports against which the tools may rest in a compact and secure yet noninterengaging stacked array, and a bracket including a platform having a width sufficient to cover the predetermined width of the standard web and a length substantially equal to the minimum length of the standard web so as to superimpositionally fit over the standard web without relative movement, top and bottom bases extending perpendicularly from the platform for a sufficient distance to provide head clearance spaced between a front wall surface and a bracket web surface for retention of a headed standard-bracket fastener, and a plurality of tabs extending from the bases for fastening the bracket and attached standard to the wall, the tabs including at least one bayonet tab extending from the bottom base perpendicularly to the bracket platform for insertion into a wall hole so as to prohibit bracket and standard motion in a plane parallel to the wall plane, and at least one hook tab having a hook shank extending perpendicularly to the bracket platform and a hook tip extending at an angle away from the hook shank so as to engage a back wall surface and to thereby retain the bracket, standard, and any held tools on the wall.

* * * * *